US007806348B2

(12) United States Patent
Kline et al.

(10) Patent No.: US 7,806,348 B2
(45) Date of Patent: Oct. 5, 2010

(54) SHOWERHEAD FOR EMERGENCY FIXTURE

(75) Inventors: Kevin B. Kline, Wauwatosa, WI (US); Robert K. Larson, Germantown, WI (US); Kevin M. Kohlwey, Port Washington, WI (US)

(73) Assignee: Bradley Fixtures Corporation, Menomonee Falls, WI (US)

( * ) Notice: Subject to any disclaimer, the term of this patent is extended or adjusted under 35 U.S.C. 154(b) by 0 days.

(21) Appl. No.: 12/146,025

(22) Filed: Jun. 25, 2008

(65) Prior Publication Data

US 2009/0321539 A1 Dec. 31, 2009

(51) Int. Cl.

| | |
|---|---|
| ***B05B 1/34*** | (2006.01) |
| ***B05B 15/02*** | (2006.01) |
| ***B05B 17/04*** | (2006.01) |
| ***A47K 3/28*** | (2006.01) |

(52) U.S. Cl. ..... 239/478; 239/11; 239/106; 239/209; 239/463; 4/596; 4/620; 4/900

(58) Field of Classification Search ..... 239/11, 239/200, 208, 209, 461, 463, 468–472, 474–483, 239/486, 491, 104, 106, 110, 111; 4/596, 4/604, 605, 612–614, 620, 900

See application file for complete search history.

(56) References Cited

U.S. PATENT DOCUMENTS

| | | | |
|---|---|---|---|
| 2,305,210 | A | 12/1942 | Wahlin |
| 2,428,748 | A | 10/1947 | Barz |
| 2,658,799 | A | 11/1953 | Fraser |
| 2,751,252 | A | 6/1956 | Wahlin et al. |
| 2,948,477 | A | 8/1960 | Fraser |
| 2,949,242 | A | 8/1960 | Blumberg et al. |
| D189,117 | S | 10/1960 | Bonzer |
| 3,072,346 | A | 1/1963 | Wahlin et al. |
| 3,146,674 | A | 9/1964 | Wahlin |
| 3,563,469 | A | 2/1971 | Stacey et al. |
| 3,865,310 | A | 2/1975 | Elkins et al. |
| 4,055,301 | A | 10/1977 | Hruby, Jr. |

(Continued)

FOREIGN PATENT DOCUMENTS

| | | |
|---|---|---|
| DE | 7112090 | 7/1971 |

(Continued)

OTHER PUBLICATIONS

Haws Corporation, Specifying Emergency Drench Showers & Eyewashes, Dec. 10, 2008, 30 pages.

(Continued)

*Primary Examiner*—Darren W Gorman
(74) *Attorney, Agent, or Firm*—Foley /& Lardner LLP

(57) ABSTRACT

An apparatus for controlling a flow of fluid in an emergency fixture is disclosed. The apparatus comprises a first control element at least partially located in the body and configured to impart rotation into the fluid flow. The second control element comprises an inlet that receives fluid, and an outlet that divides the fluid flow into at least a first portion and a second portion. The outlet comprises a first outlet portion and a second outlet portion. The first outlet portion guides the first portion of the flow out of the flow rotation element as an axial flow, and wherein the second outlet portion provides rotation to the second portion of the flow relative to the axial flow.

24 Claims, 7 Drawing Sheets

U.S. PATENT DOCUMENTS

| | | | | |
|---|---|---|---|---|
| 4,274,595 | A * | 6/1981 | Yamin | 239/383 |
| 4,598,866 | A | 7/1986 | Cammack et al. | |
| 5,008,963 | A | 4/1991 | Stein | |
| 5,530,972 | A | 7/1996 | Tanner | |
| 5,862,985 | A | 1/1999 | Neibrook et al. | |
| 6,205,599 | B1 | 3/2001 | Anders | |
| 6,254,013 | B1 * | 7/2001 | Clearman et al. | 239/222.11 |
| 6,923,386 | B2 | 8/2005 | Bonzer | |
| 2006/0102750 | A1 * | 5/2006 | Grether | 239/428.5 |
| 2007/0204398 | A1 | 9/2007 | Dubois | |
| 2009/0288251 | A1 | 11/2009 | Strandberg et al. | |

FOREIGN PATENT DOCUMENTS

| | | |
|---|---|---|
| DE | 9418847 | 2/1995 |
| FR | 1063462 | 5/1954 |

OTHER PUBLICATIONS

Whirl, WL Low Flow/Full Cone, www.BETE.com, available at least by Jun. 25, 2008, 3 pages.

International Search Report for International Application No. PCT/US2009/045979, mail date Sep. 29, 2009, 2 pages.

English translation of previously cited German Utility Model Registration No. G 94 18 847.5 to Zvonko, Zdejlar, 17 pages.

Haws Corporation, Introducing the Revolutionary New axion ™ msr, 2008, 6 pages.

* cited by examiner

SHOWERHEAD FOR EMERGENCY FIXTURE

BACKGROUND

The present invention relates to a showerhead for emergency fixture.

It is generally known to provide a showerhead for an emergency fixture. Such a showerhead is typically configured to release a spray of water to soak a user in an emergency situation (e.g., to extinguish a fire, to rinse off a dangerous substance, etc.).

It would be advantageous to provide a showerhead for emergency fixture. It would also be advantageous to provide a showerhead that creates a more uniform spray pattern. It would also be advantageous to provide a showerhead that provides a more uniform spray pattern from a single outlet to reduce the chance of blockage from dirt or other deposits in the water. It would be desirable to provide for a showerhead for emergency fixture having one or more of these or other advantageous features. To provide an inexpensive, reliable, and widely adaptable showerhead for emergency fixture that avoids the above-referenced and other problems would represent a significant advance in the art

SUMMARY

One embodiment of the invention relates to an apparatus for controlling a flow of fluid in an emergency fixture. The apparatus comprises a first control element at least partially located in the body and configured to impart rotation into the fluid flow. The first control element comprises an inlet that receives fluid, and an outlet that divides the fluid flow into at least a first portion and a second portion. The outlet comprises a first outlet portion and a second outlet portion. The first outlet portion guides the first portion of the flow out of the first control element as an axial flow. The second outlet portion provides rotation to the second portion of the flow relative to the axial flow.

The present invention also relates to a method of controlling a flow of fluid in an emergency fixture. The method comprises providing a showerhead having a first control element; providing a fluid flow to the inlet of the showerhead; flowing the fluid flow into the first flow control element and separating the fluid flow into a first flow portion and a second flow portion; flowing the first flow portion through a first outlet on a path coaxial with an axis of the first control element; and flowing the second flow portion through a second outlet on a path rotating relative to the axis of the first control element.

The present invention further relates to an emergency fixture configured to deliver a fluid. The emergency fixture comprises a valve; a showerhead coupled to the valve and having a body, a flow volume control element and a flow rotation control element. The flow volume control element is configured to control the volume of the fluid flow. The flow rotation control element is located downstream from the flow volume control element and is configured to impart rotation into the fluid flow. The flow rotation control element comprises an inlet that receives fluid from the flow volume control element and an outlet. The outlet comprises a first outlet portion defining a bore for a first portion of the fluid flow, and a second outlet portion defining an annular opening circumscribing the bore of the first outlet portion and for a second portion of the fluid flow. At least one member extends across the annular opening and has a deflection surface angled relative to the direction of the first portion of the flow so that liquid deflects off the deflection surface during use. The first outlet portion guides the first portion of the flow out of the flow rotation control element as an axial flow, and wherein the second outlet portion provides rotation to the second portion of the flow relative to the axial flow.

The present invention further relates to various features and combinations of features shown and described in the disclosed embodiments. Other ways in which the objects and features of the disclosed embodiments are accomplished will be described in the following specification or will become apparent to those skilled in the art after they have read this specification. Such other ways are deemed to fall within the scope of the disclosed embodiments if they fall within the scope of the claims which follow.

Figure 1:
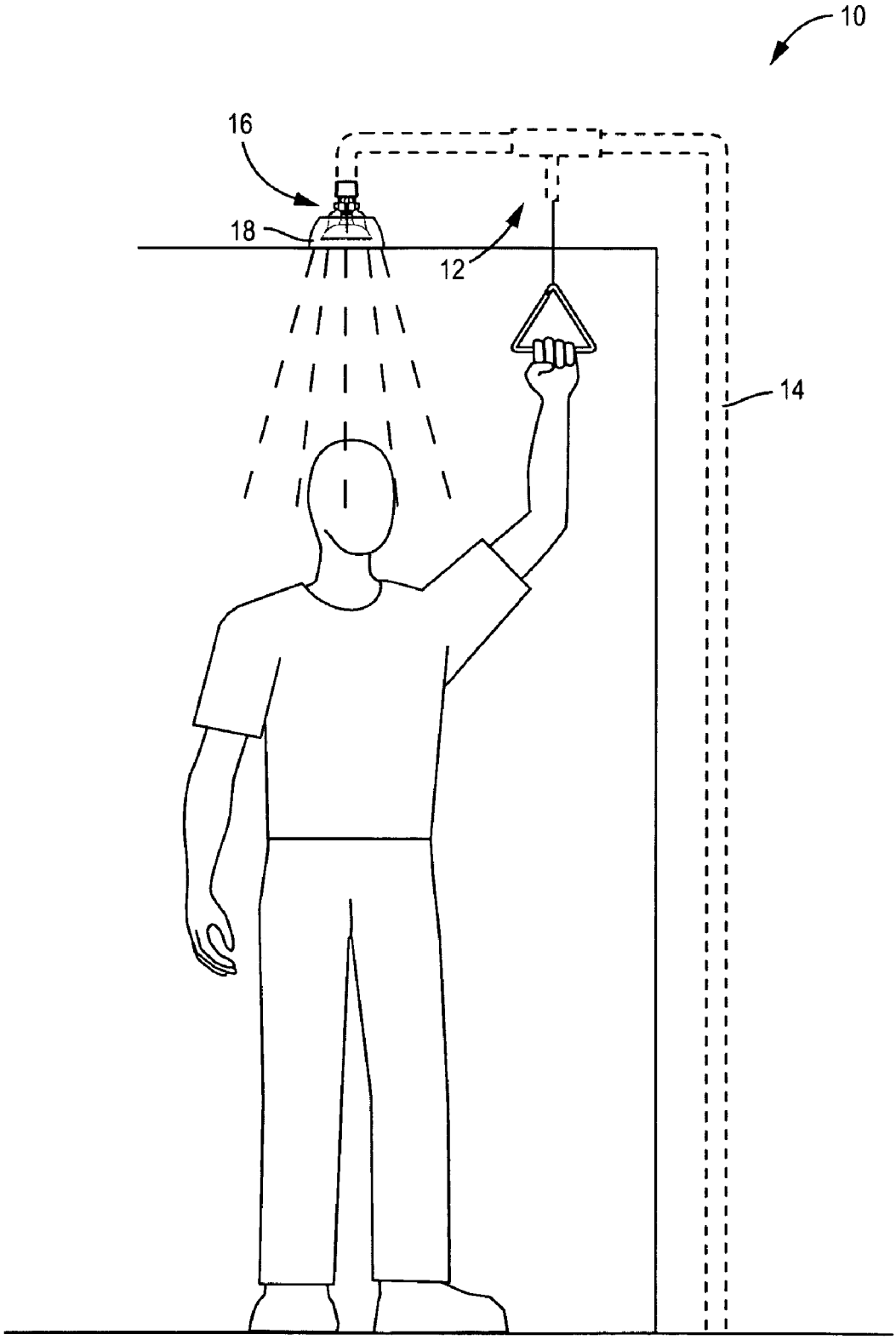
FIG. 1 is a side view of an emergency fixture (shower) including a showerhead assembly according to an exemplary embodiment mounted flush to the ceiling.

Before explaining a number of preferred, exemplary, and alternative embodiments of the invention in detail it is to be understood that the invention is not limited to the details of construction and the arrangement of the components set forth in the following description or illustrated in the drawings. The invention is capable of other embodiments or being practiced or carried out in various ways. It is also to be understood that the phraseology and terminology employed herein is for the purpose of description and should not be regarded as limiting.

DETAILED DESCRIPTION OF EXEMPLARY AND PREFERRED EMBODIMENTS

Before proceeding to the detailed description of the preferred and exemplary embodiments, several comments can be made about the general applicability and the scope thereof.

First, while the components of the disclosed embodiments will be illustrated as a showerhead designed for an emergency shower fixture, the features of the disclosed embodiments have a much wider applicability. For example, the showerhead design is adaptable for other applications requiring a desired spray pattern/quantity of water, such as residential, commercial, and industrial installations.

Second, the particular materials used to construct the exemplary embodiments are also illustrative. For example, injection molded acrylonitrile butadiene styrene ("ABS") are an exemplary method and material for making the nozzle and spinner, and injection molded acetal plastic are an exemplary method and material for making the flow control (with the o-ring being EPDM rubber), but other materials can be used, including other thermoplastic resins such as polypropylene, high density polyethylene, other polyethylenes, polyurethane, nylon, any of a variety of homopolymer plastics, copolymer plastics, plastics with special additives, filled plastics, etc. Also, other molding operations may be used to form these components, such as blow molding, rotational molding, etc. Components of the showerhead can also be manufactured from cast or forged metal including but not limited to stainless steel or aluminum.

Figure 12:
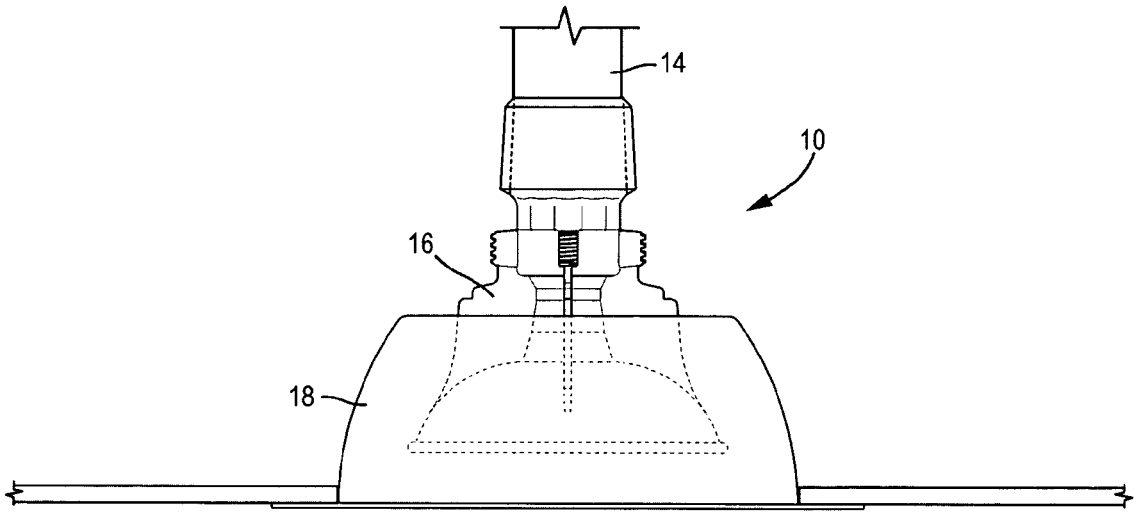
FIG. 12 is a side view of the showerhead assembly of FIG. 2 mounted according to one exemplary embodiment.
Figure 13:
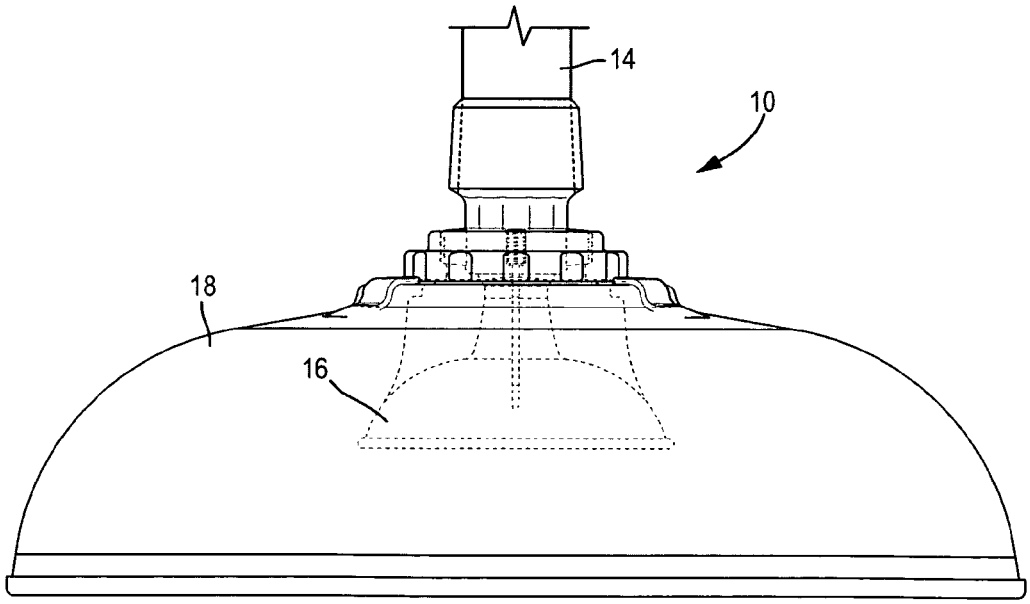
FIG. 13 is a side view of the showerhead assembly of FIG. 2 mounted according to another exemplary embodiment.
Figure 14:
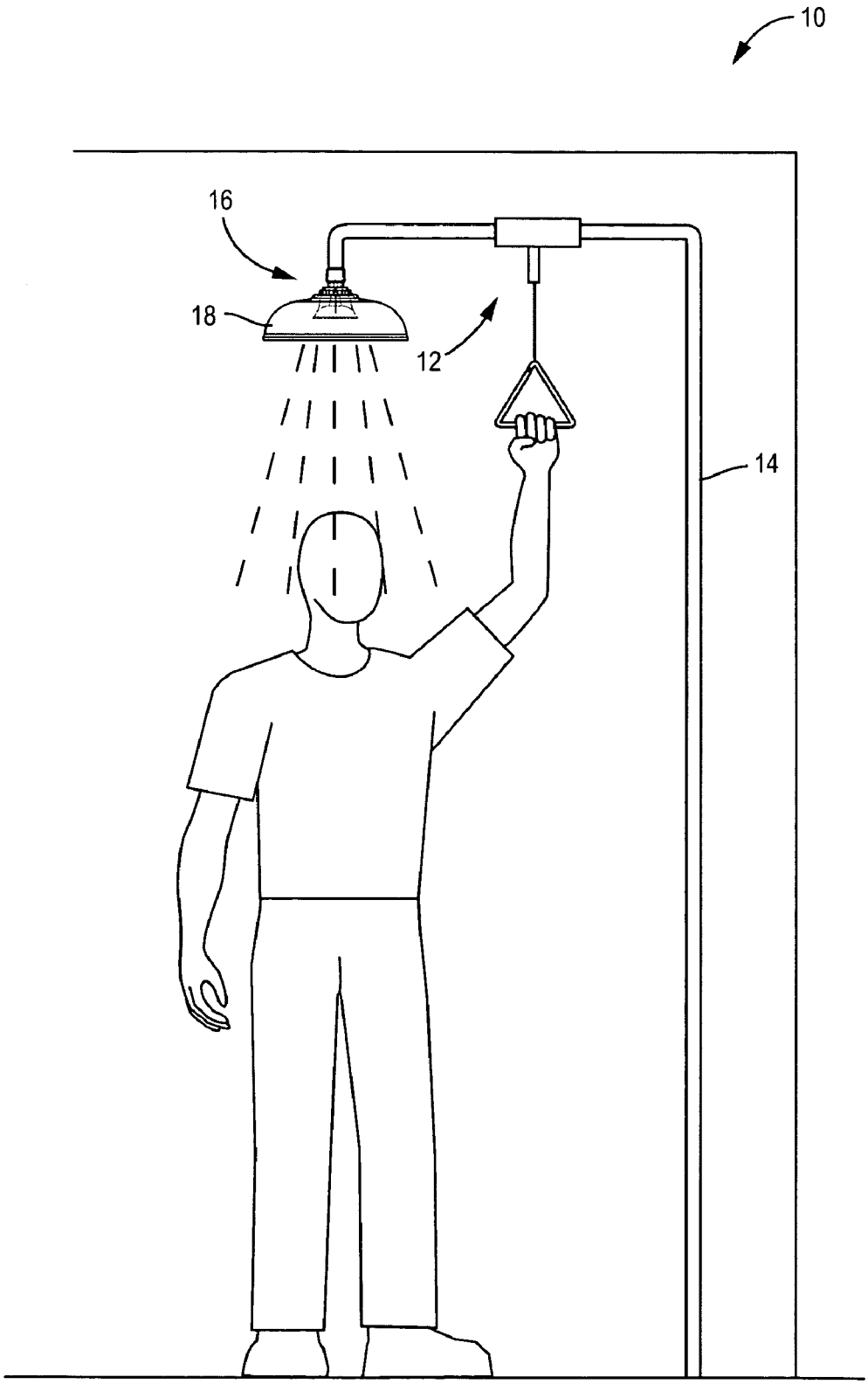
FIG. 14 is a side view of a free-standing emergency fixture (shower) including a showerhead assembly according to an exemplary embodiment.

Referring to FIG. 1, an emergency fixture 10 is shown as an emergency shower according to an exemplary embodiment. Such fixtures 10 are often provided in laboratories or other environments where hazardous conditions due to fire or chemicals may be present. In such environments, where the eyes or body of any person may be exposed to corrosive or otherwise hazardous materials, emergency fixtures 10 provide quick drenching or flushing of the body. Emergency fixtures 10 may include an eyewash station (not shown) to flush the eyes of a user and/or an overhead showerhead 16 that drenches the body of a user. Emergency fixtures 10 are generally controlled by a valve 12 activated by a mechanism (shown as a pull cord in FIG. 1, but may be a lever, button, or the like), that allows water or another substance flow through plumbing 14 to emerge from the eyewash station and/or showerhead 16. According to various exemplary embodiments, the plumbing 14 for emergency fixture 10 may be wholly exposed, partially exposed, or may be concealed within the walls and ceiling. For example as shown in FIGS. 1 and 12, the showerhead 16 may be recessed into the ceiling and a shroud and trim plate or other trim piece 18 may be mounted to trim out the hole. According to another exemplary embodiment, as shown in FIGS. 13 and 14, the showerhead 16 may be mounted below the ceiling (e.g., on a free-standing unit) and the trim piece 18 may be a bowl coupled to the showerhead 16.

Figure 2:
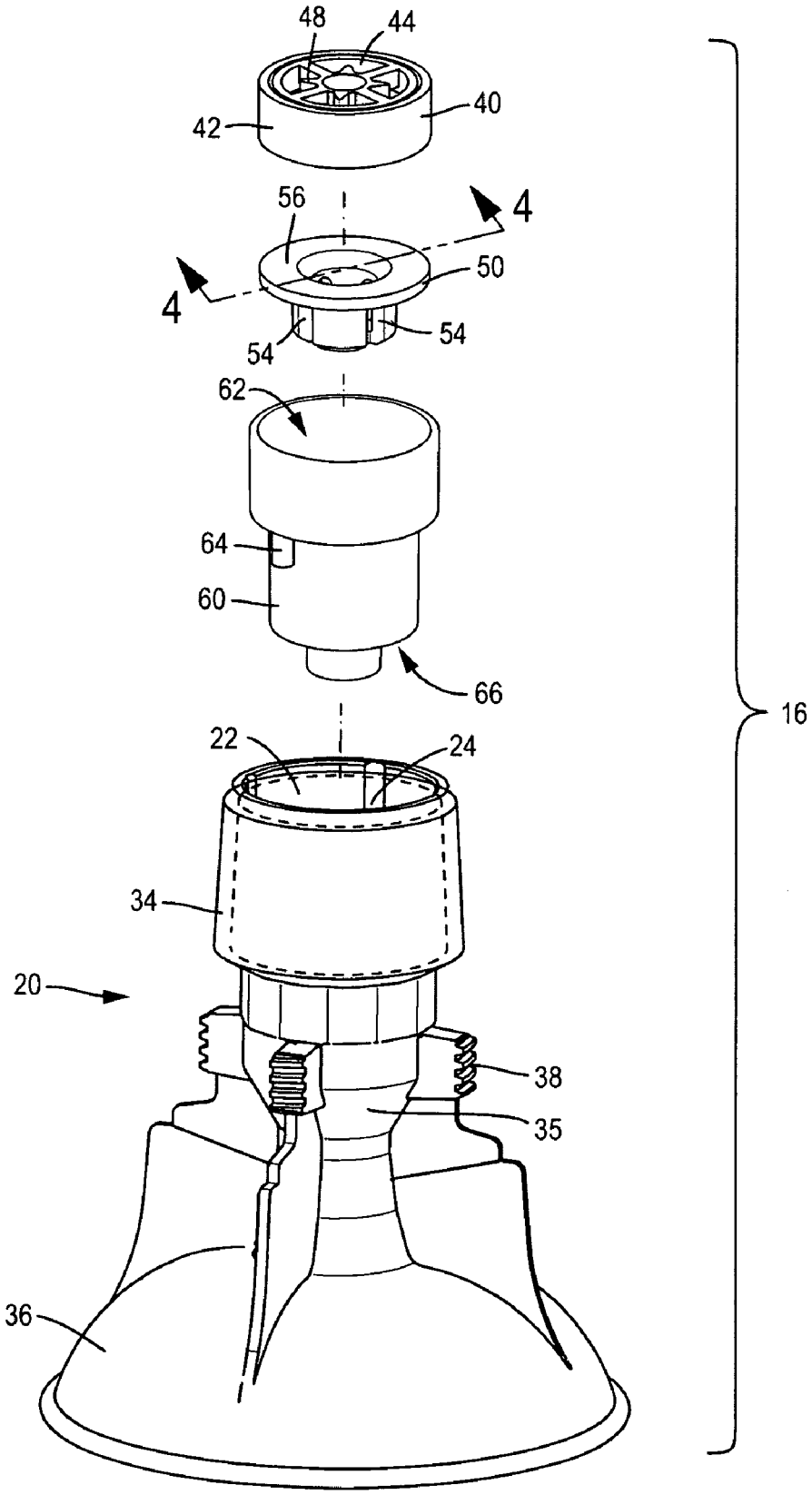
FIG. 2 is an exploded view of a showerhead assembly according to an exemplary embodiment.

Referring now to FIG. 2, a showerhead assembly 16 is shown that provides a more uniform spray pattern, and is intended to meet both United States (e.g., local, state and/or federal) and new European specifications and provide an improved washdown through a single outlet. Showerhead assembly 16 includes a main housing or body 20, a flow volume control element 40, a diverter 50, and a flow rotation control element 60. Flow volume control elements 40 and diverter 50 are held within flow rotation control member or element 60 which is, in turn, held within main body 20. Flow volume control element 40, diverter 50, and flow rotation control element 60 alter the flow of water supplied to showerhead assembly 16.

Figure 10:
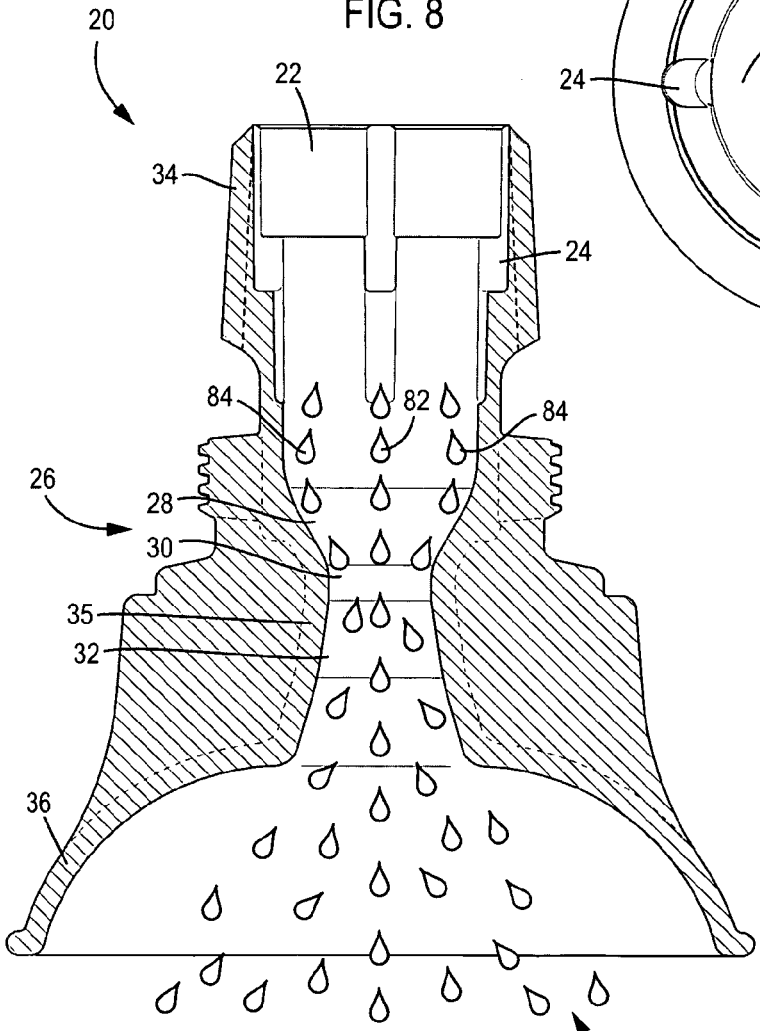
FIG. 10 is a cross section of a portion of the main body of the showerhead assembly of FIG. 2 schematically showing the fluid flow through the nozzle according to an exemplary embodiment.

Referring to FIGS. 2 and 10, main body or housing 20 includes a head portion 34, a neck portion 35 and a bell portion 36. Head portion 34 may include threads to couple showerhead assembly 16 to plumbing 14 (e.g. with a threaded coupling). A trim piece (shown in FIG. 13) may be provided that is coupled to main body 20 with additional threaded protrusions 38. Main body 20 includes a bore 22 that extends from head portion 34, through neck portion 35 to bell portion 36. Bore 22 has a first portion that receives the flow rotation control element 60 and a second portion, downstream from the first portion, that forms a nozzle 26 (shown best in FIG. 10).

Figure 9:
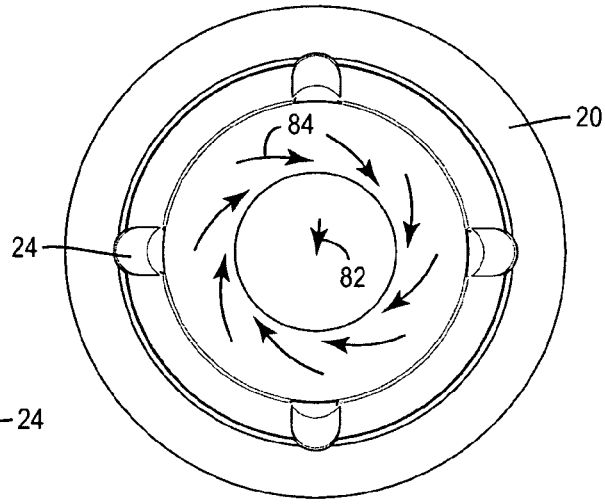
FIG. 9 is a top view of the main body of the showerhead assembly of FIG. 2 schematically showing the first and second fluid paths through the inlet and throat portions of the nozzle formed by the main body.

Referring to FIGS. 2, 9, and 10, longitudinal recesses or grooves 24 are formed in the first portion of bore 22. According to an exemplary embodiment, four grooves 24 are formed in bore 22 spaced evenly around bore 22. At least one of grooves 24 receives a projection 64 on flow rotation control element 60 to inhibit the rotation of flow rotation control element 60 relative to main body 20 during operation of showerhead assembly 16, as will be described in more detail below. Grooves 24 further provide drainage notches to facilitate the passage of air and/or water through bore 22 between flow rotation control element 60 and main body 20. Sufficient drainage is desirable to reduce stagnant water pooling within showerhead assembly 16 which may provide conditions for the growth of mold, bacteria, or other undesirable organisms.

Figure 3:
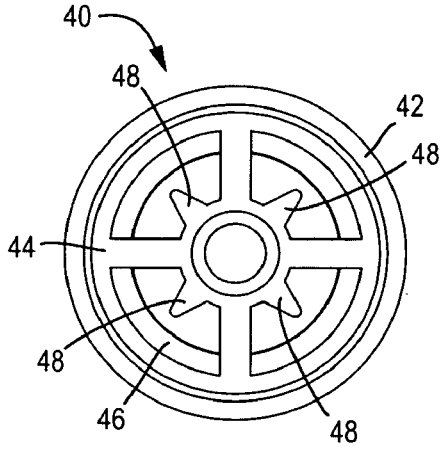
FIG. 3 is a top plan view of a flow regulator for the showerhead assembly of FIG. 2 according to one exemplary embodiment.

Referring now to FIG. 3, flow volume control element 40 is shown according to one exemplary embodiment. Flow volume control element 40 is a flow regulator configured to maintain a generally constant flow rate at a range of pressures. One exemplary flow regulator is an L-Type flow regulator, model number 58.6668.1 commercially available from NEOPERL Inc of Waterbury, Conn. Flow volume control element 40 includes an outer member 42 with a central opening and an inner member 44 that nests within outer member 42. A resilient member, such as o-ring 46, is trapped between the end walls of inner member 44 and outer member 42 on the downstream side of flow volume control element 40. As the pressure difference across flow volume control element 40 increases (e.g., between the upstream and downstream sides) the o-ring 46 is forced into the central opening of flow volume control element 40, thereby reducing (i.e., controlling) the flow rate of liquid through flow volume control element 40. As the pressure difference is reduced, o-ring 46 retracts from the central opening and forces inner member 44 upstream. Flow 80 (FIG. 10) through flow volume control element 40 is further obstructed by spokes 48 on inner member 44. The size and/or number of spokes 48 on a control member 40 may be decreased or increased to increase or decrease the flow through the control member 40. According to a preferred embodiment, flow volume control element 40 limits the flow rate to between approximately 17 and 24 gallons per minute (gpm). For example, at a low pressure such as 20 psi, flow volume control element may limit the flow to 17 gpm. At a higher pressure such as 50 psi, flow volume control element may limit the flow to 24 gpm.

According to other exemplary embodiments, flow volume control element 40 is not be housed within main body 20 and may be provided further upstream from showerhead assembly 16. According to other exemplary embodiments, flow volume control element 40 may be a different volume control element such as a valve.

Figure 6:
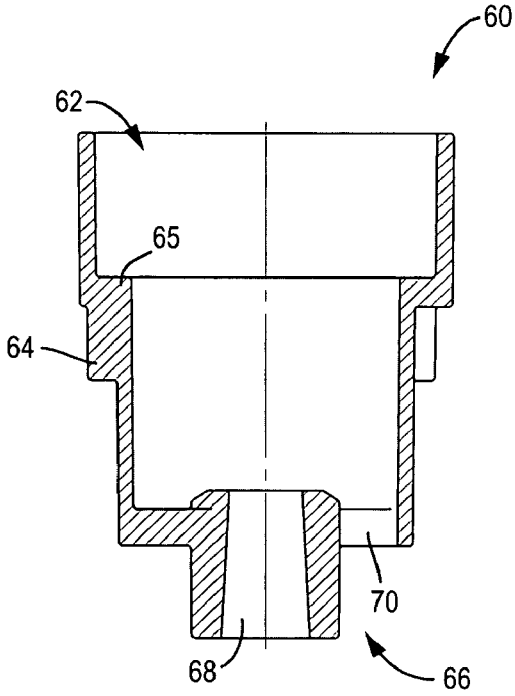
FIG. 6 is a cross section of the flow rotation control element of FIG. 5 taken along line 6-6.
Figure 4:
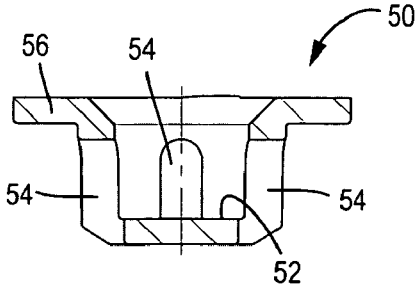
FIG. 4 is a cross section of a flow diverter of FIG. 2 according to an exemplary embodiment taken along line 4-4.

After passing through flow volume control element 40, the water passes through diverter 50. Diverter 50 is configured to redirect the flow 80. Referring now to FIG. 4, diverter 50 is a cup-shaped member with an end wall 52, one or more side openings 54, and a flange 56. Diverter 50 is housed within second control element 60 with flange 56 resting on an interior shoulder or ledge 65 of second control element 60, as shown in FIG. 6. Water flowing through diverter 50 hits end wall 52 and is redirected through side openings 54. According to an exemplary embodiment, four openings 54 are provided spaced equally about the circumference of diverter 50. The flow 80 through diverter 50 is shown schematically in FIG. 8.

Figure 5:
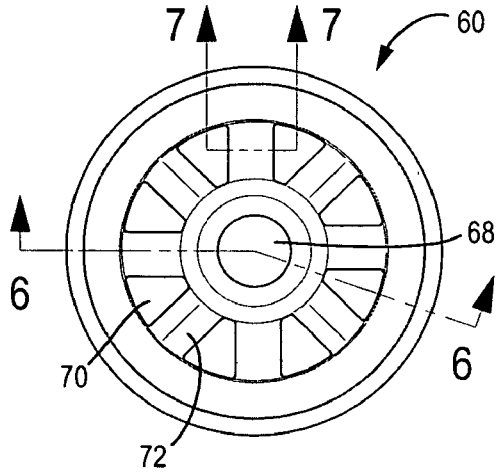
FIG. 5 is a top plan view of a flow rotation control element for the showerhead assembly of FIG. 2 according to an exemplary embodiment.
Figure 7:
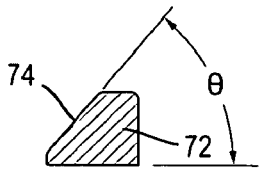
FIG. 7 is a cross section of a portion of the flow rotation control element of FIG. 5 taken along line 7-7-showing an angled deflection surface according to an exemplary embodiment.

Referring now to FIGS. 5-7, second control element (or flow rotation element) 60 is shown according to one exemplary embodiment. Second control element 60 imparts a rotation on at least a portion of the flow passing through showerhead assembly 16. Second control element 60 is a generally tubular member with an inlet 62 that receives flow volume control element 40 and diverter 50, and an outlet 66. According to one exemplary embodiment, two projections 64 protrude outward from opposite sides of second control element 60. Projections 64 are longitudinal elements that are received in grooves 24 formed in bore 22 of main body 20. As second control element 60 imparts a rotation on the flow, an opposite rotational force is in turn applied to second control element 60. With projections 64 seated in grooves 24, second control element 60 is restrained from rotating relative to main body 20. According to other exemplary embodiments, second control element 60 may be restrained from rotating relative to main body 20 with another mechanism. For example, second control element 60 may be restrained with an adhesive, a fastener, or some other suitable mechanism. An inwardly extending shoulder or ledge 65 provides a surface upon which diverter 50 rests, as shown best in FIG. 8.

Outlet 66 of second control element 60 includes a first outlet portion 68 (e.g., port, aperture, orifice, opening, etc.) and a second outlet portion 70 (e.g., port, aperture, orifice, opening, etc.). First outlet portion 68 forms a generally bore (e.g., cylindrical, conical, elliptical, rectangular, etc.) aligned with the longitudinal axis of second control element 60. Second outlet portion 70 defines an annular opening circumscribing first outlet portion 68. One or more radial members 72 extend across second outlet portion 70. Radial members 72 form an angled deflection surface 74, shown best in FIG. 7. According to a preferred embodiment, angled deflection surface 74 has an angle θ between 10 degrees and 80 degrees According to a particularly preferred embodiment, angled deflection surface 74 has an angle θ of approximately 40 degrees.

Figure 8:
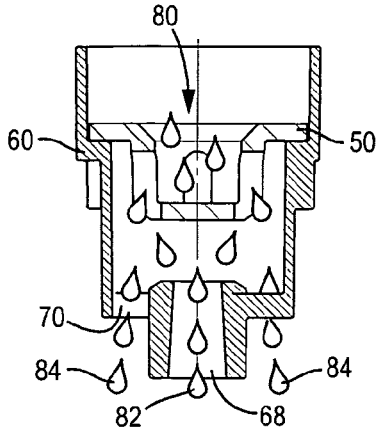
FIG. 8 is a cross section of a portion of the showerhead assembly of FIG. 2 schematically showing the fluid flow through the flow diverter and flow rotation control element according to an exemplary embodiment.

Referring to FIGS. 6, 7 and 8, outlet 66 divides the flow 80 into a first portion 82 and a second portion 84. First flow portion 82 is a generally axial flow, passing through first outlet portion 68 and flowing parallel to the longitudinal axis of second control element 60. Second flow portion 84 passes through second outlet portion 70. Second flow portion 84 is redirected by angled deflection surfaces 74 (shown in FIG. 7) so that it rotates about first flow portion 82, as shown best in FIG. 9.

Referring now to FIG. 10, axial first flow portion 82 and rotating second flow portion 84 pass from second control element 60 into nozzle 26. Nozzle 26 includes an inlet portion 28, a throat, 30, and an outlet portion 32. Inlet portion 28 has an initial cross-section approximately the same size as the cross-section of bore 22 proximate to second control element 60. The cross-section of inlet portion 28 narrows as the downstream distance from second control element 60 increases. Throat 30 provides a minimum cross-section of nozzle 26. The cross-section of outlet portion 32 expands as the downstream distance from throat 30 increases until it opens into bell section 36.

At least a portion of second flow portion 84 flows along the walls of nozzle 26. Proximate to second control element 60, second flow portion 84 comprises a generally stable (e.g., organized, even, predictable, etc.) flow. As second flow portion 84 passes downstream, through throat 30, it becomes an unstable, turbulent flow. The unstable flow causes second flow portion 84 to disperse and diverge as it passes from throat 30 to outlet 32 and out of showerhead assembly 16 to drench a user. First flow portion 82 continues generally along the longitudinal axis of nozzle 26 and forms the inner portion of the spray pattern while second flow portion expands to create the outer portion of the spray pattern.

By using a single large opening (e.g., outlet 32) to expel water from showerhead assembly 16 instead of a larger head with multiple outlets to direct water to specific areas, there is a reduced chance for dirt or other particles in the water to block the outlet and reduce the effectiveness of emergency fixture 10. Further, a single large outlet 32 is effected less than multiple smaller outlets to corrosion build up.

Figure 11:
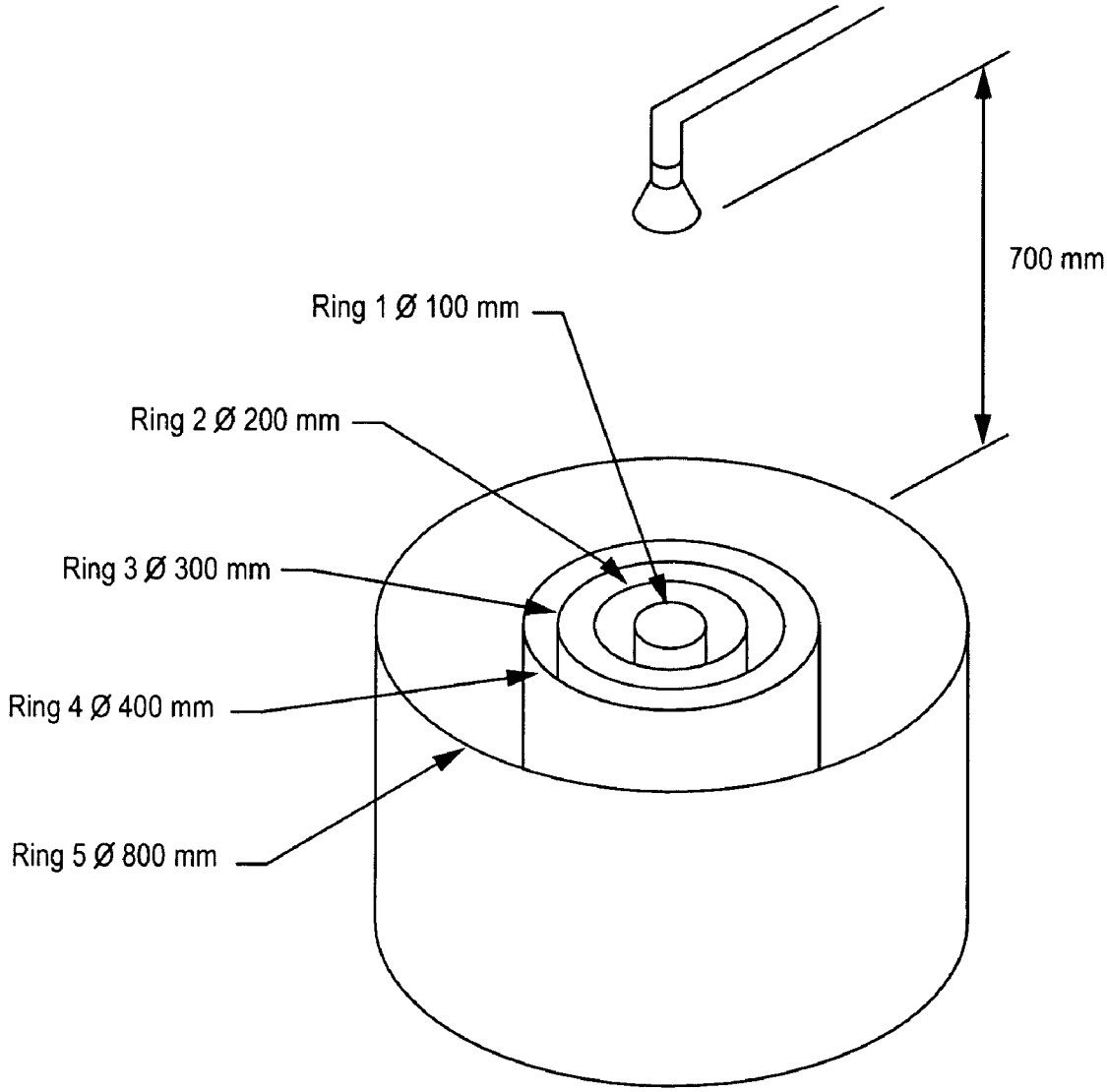
FIG. 11 is an isometric view of an apparatus for testing an emergency fixture.

To assure that the water emerging from showerhead 16 sufficiently covers the body of a user, the spread and pattern of the spray is intended to be carefully controlled. For example, European Standard EN15154-1 requires that plumbed-in body showers pass a test procedure involving water falling onto an apparatus including a series of circles, shown in FIG. 11. At a distance 700 mm below the shower head, 50±10% of the water falls in a circle 400 mm in diameter. Further the water falling within a 100 mm circle and the water falling in annular areas between the 100 mm circle and the 200 mm circle, the 200 mm circle and the 300 mm circle, and the 300 mm circle and the 400 mm circle must each deviate by less than 30% from the mean value. Still further, 95% of the water must fall within a circle 800 mm in diameter.

For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. Such joining may also relate to mechanical, fluid, or electrical relationship between the two components.

It is also important to note that the construction and arrangement of the elements of the showerhead as shown in the preferred and other exemplary embodiments are illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present invention as expressed in the appended claims.

What is claimed is:

1. An apparatus for controlling a flow of fluid in an emergency fixture, the apparatus comprising:

a body;

a first control element at least partially located in the body and configured to impart rotation into the fluid flow, the first control element comprising:

an inlet that receives fluid;

an outlet that divides the fluid flow into at least a first portion and a second portion, the outlet comprising a first outlet portion and a second outlet portion; and at least one radial member extending across the second outlet portion and restrained from rotating relative to the body; and a second control element configured to control the volume of the fluid flow and located upstream of the first control element;

wherein the body includes at least one drainage notch to allow air and water to pass between the second control element and the body;

wherein the first outlet portion guides the first portion of the flow out of the first control element as an axial flow, and wherein the second outlet portion provides rotation to the second portion of the flow relative to the axial flow.

2. The apparatus of claim 1 wherein the first outlet portion defines a bore.

3. The apparatus of claim 2 wherein the second outlet portion defines an annular opening circumscribing the bore of the first outlet portion.

4. The apparatus of claim 3 wherein the second portion of the flow rotates about the first portion of the flow.

5. The apparatus of claim 4 wherein the at least one radial member extends across the annular opening, the at least one radial member having a deflection surface angled relative to the direction of the second portion of the flow, wherein liquid deflects off the deflection surface.

6. The apparatus of claim 5 wherein the angle is between about 10 degrees and about 80 degrees relative to the direction of the second portion of the flow.

7. The apparatus of claim 6 wherein the angle is about 40 degrees relative to the direction of the second portion of the flow.

8. An apparatus for controlling a flow of fluid in an emergency fixture, the apparatus comprising:

a body;

a first control element at least partially located in the body and configured to impart rotation into the fluid flow, the first control element comprising an inlet that receives fluid, and an outlet that divides the fluid flow into at least a first portion and a second portion, the outlet comprising a first outlet portion and a second outlet portion;

a second control element configured to control the volume of the fluid flow and located upstream of the first control element;

wherein the first control element at least partially receives the second control element;

wherein the body includes at least one drainage notch to allow air and water to pass between the second control element and the body;

wherein the first outlet portion guides the first portion of the flow out of the first control element as an axial flow, and wherein the second outlet portion provides rotation to the second portion of the flow relative to the axial flow.

9. The apparatus of claim 8 wherein the body receives the first control element.

10. The apparatus of claim 9 wherein the body includes at least one groove configured to receive a projection extending from the first control element to inhibit the first control element from rotating during operation.

11. The apparatus of claim 1 wherein the body includes a bore having a first portion and a second portion, wherein the first portion of the bore receives the first control element, the second portion of the bore is located downstream from the first portion and provides a nozzle to configure the fluid flow.

12. The apparatus of claim 11 wherein the nozzle includes an inlet portion, a throat, and an outlet portion, the cross-section of the inlet portion narrows as the downstream distance from the first control element increases, the throat provides a minimum cross-section of the nozzle, and the cross-section of the outlet portion expands as the downstream distance from the throat increases.

13. The apparatus of claim 12 wherein the second portion of the flow flowing through the inlet portion of the nozzle induces an unstable flow as the rotating and axial flows merge.

14. A method of controlling a flow of fluid in an emergency fixture comprising:

providing a showerhead having an inlet, a body and a first control element;

providing a second control element located upstream of the first control element and at least partially received in the first control element;

providing at least one groove in the body to allow air and water to pass between the second control element and the body;

providing a fluid flow to the inlet of the showerhead;

flowing the fluid flow through the second control element to control the volume of fluid flow;

flowing the fluid flow into the first flow control element and separating the fluid flow into a first flow portion and a second flow portion;

flowing the first flow portion through a first outlet on a path coaxial with an axis of the first control element;

flowing the second flow portion through a second outlet on a path rotating relative to the axis of the first control element.

15. The method of claim 14 further comprising combining the first flow portion and the second flow portion into a combined fluid flow downstream from the first flow control element.

16. The method of claim 15 further comprising constricting the combined fluid flow by decreasing the cross-sectional area through which the combined fluid flow flows.

17. The method of claim 16 further comprising expanding the combined fluid flow by increasing the cross-sectional area through which the combined fluid flow flows.

18. The method of claim 14 wherein the step of flowing the fluid flow through the second control element is before the step of flowing the fluid flow into the first control element.

19. The method of claim 14 wherein the at least one groove is configured to drain fluid from the showerhead when the fluid flow is not being provided to the inlet of the showerhead.

20. An emergency fixture for delivering a flow of fluid, the emergency fixture comprising:

a valve;

a showerhead coupled to the valve and having a body, a flow volume control element, and a flow rotation control element;

the flow volume control element configured to control the volume of the fluid flow;

at least one interior groove defined in the body to allow air and water to pass between the flow volume control element and the body;

the flow rotation control element is located downstream from the flow volume control element and is configured to impart rotation into the fluid flow, the flow rotation control element comprising:

an inlet that receives fluid from the flow volume control element;

an outlet comprising a first outlet portion defining a bore for a first portion of the fluid flow, and a second outlet portion defining an annular opening circumscribing the bore of the first outlet portion and for a second portion of the fluid flow;

at least one non-rotating member extending across the annular opening, the member is restrained from rotating relative to the body and having a deflection surface angled relative to the direction of the first portion of the flow so that liquid deflects off the deflection surface during use;

wherein the first outlet portion guides the first portion of the flow out of the flow rotation control element as an axial flow, and wherein the second outlet portion provides rotation to the second portion of the flow relative to the axial flow.

21. The apparatus of claim 20 wherein the body includes a nozzle having an inlet portion, a throat, and an outlet portion, the cross-section of the inlet portion narrows as the downstream distance from the flow rotation control element increases, the throat provides a minimum cross-section of the nozzle, and the cross-section of the outlet portion expands as the downstream distance from the throat increases.

22. The apparatus of claim 21 wherein the second portion of the flow flowing through the inlet portion of the nozzle induces an unstable flow path as the rotating and axial flows merge.

23. The apparatus of claim 20 wherein the at least one interior groove is configured to allow draining of fluid when not in use.

24. The apparatus of claim 20 wherein the flow rotation control element at least partially receives the flow volume control element.

* * * * *